US005415002A

United States Patent [19]

Koenig

[11] Patent Number: 5,415,002

[45] Date of Patent: May 16, 1995

[54] THERMAL EXCHANGER FOR BEVERAGES

[76] Inventor: Don M. Koenig, 2184 LaVista Rd., Atlanta, Ga. 30329

[21] Appl. No.: 166,829

[22] Filed: Dec. 15, 1993

[51] Int. Cl.[6] ..... F25D 3/08

[52] U.S. Cl. ..... 62/63; 62/529; 62/457.2

[58] Field of Search ..... 62/529, 530, 62, 457.2, 62/63

[56] References Cited

U.S. PATENT DOCUMENTS 4,091,632 5/1978 Marchewka et al. ..... 62/1
4,554,189 11/1985 Marshall ..... 62/530 X

FOREIGN PATENT DOCUMENTS 2003392 8/1970 Germany ..... 62/529

*Primary Examiner*—William E. Tapoical

[57] ABSTRACT

Thermal Exchanger for Beverages is a reusable, attachable cover for a cup type or can type beverage container. The container's contents can be almost any kind of beverage. The contents in the beverage container can be at room temperature or even hot. The beverage is chilled by sucking on the exposed end of a straw like tube the same way as you would suck on a conventional straw. The degree of temperature decrease of the beverage is dependent on the temperature of the beverage in the container, the type of frozen matter used in the retention mass, and the amount of time the beverage remains in the Thermal Exchanger. Within the attachable cover, the straw like apparatus is coiled inside a surrounding envelope containing a freezable gel of the type that is used in various applications such as freezer packs. The entire Thermal Exchanger is placed in a freezer for several hours until the gel is frozen. When attached to the beverage container where it will be used, it is initially either in a frozen state or almost in a frozen state. As the liquid in the container is drawn through the straw like tube as a result of the user's sipping action, the Thermal Exchanger removes heat from the beverage.

1 Claim, 3 Drawing Sheets

THERMAL EXCHANGER FOR BEVERAGES

BACKGROUND-FIELD OF INVENTION

This invention relates to a thermal exchanger cap, designed to either fit over the top or attach to the top of a cup or a can containing a warm or even hot beverage, which chills the beverage as it is drawn up through the thermal exchanger as a result of the sipping action by the user on the top end of the straw like tube.

OBJECTS AND ADVANTAGES

My patent for the Thermal Exchanger for Beverages has the following distinct advantages for chilling drinks of all kinds.

1. It can be used anywhere. With my Thermal Exchanger, there will no longer be any need to have to carry an ice chest full of ice in order to have a cold beverage available when you want it. The user just attaches the Thermal Exchange Cap to the top of a cup or can and commences sipping the beverage through the Thermal Exchanger.
2. It can be used at any time. Since the Thermal Exchanger for Beverages is kept in a freezer until the user takes it with him to wherever he is going the Thermal Exchanger will be able to chill the user's beverages for many hours.
3. It can be used on warm or hot drinks. Even though the beverage is at room temperature or even hot when the user decides to drink it the beverage will be chilled down to a cool-to-cold temperature range as it passes through the Thermal Exchanger. The coolness of the beverage as it enters the user's mouth will be determined by long the beverage remains in the exchanger.
4. It can be used with almost any type of beverage. Because the various available sizes of the Thermal Exchange Cap fit on plastic cups, ceramic or pottery cups, drinking glasses, wide mouth glass and plastic bottles, soft drink cans, beer cans, paper cups and Styrofoam cups, the user can use the exchanger to chill all types of beverages, including plain water.
5. It is completely reusable. The Thermal Exchanger for Beverages can be reused over and over again. All the user has to do is rinse out the straw like drinking tube in order to remove any minor residual beverage taste which might remain in the tube, and re-chill the exchanger in a freezer.
6. It does not need any maintenance. Since the Thermal Exchange cap is completely sealed and the freezable gel inside it's sealed housing does not "break down" after repeated freezing and thawing, the unit does not need any type of maintenance.
7. It will never wear out. Since the Thermal Exchanger for Beverages does not have any movable parts, it will not ever wear out.
8. It is completely safe to use. Due to the fact the Thermal Exchange device consists of a attaching device to fit on plastic cap or metal can top, freezable gel sealed inside a tough plastic housing, and a straw like sipping tube, there are no mechanical or chemical reactions involved in it's operation; it works strictly on a passive heat transfer principle.

DRAWING FIGURES

The drawings shown here for the Thermal Exchanger for Beverages demonstrate both the embodiments of the Thermal Exchanger and several examples of the type of promotional use for which we plan to use the embodiments.

DESCRIPTION OF PREFERRED EMBODIMENTS

Figure 1:
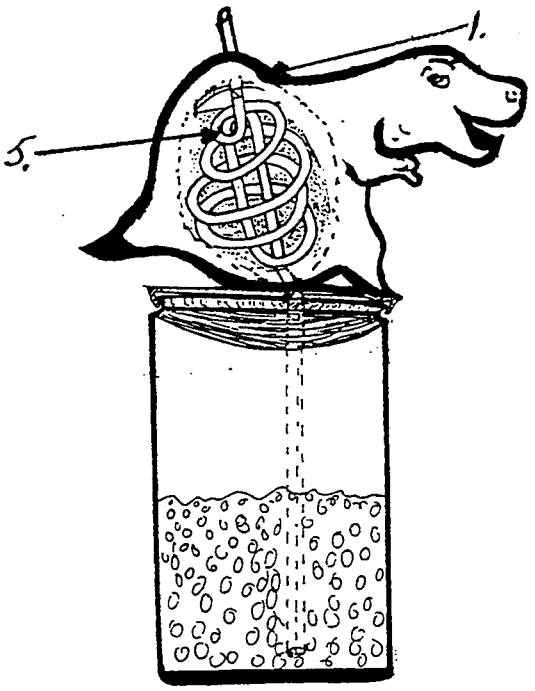
FIG. 1 represents a side view of an insulating outer jacket which will be used as a promotional item with the broken lines in the lower center of the image representing the embodiment of the invention.
Figure 2:
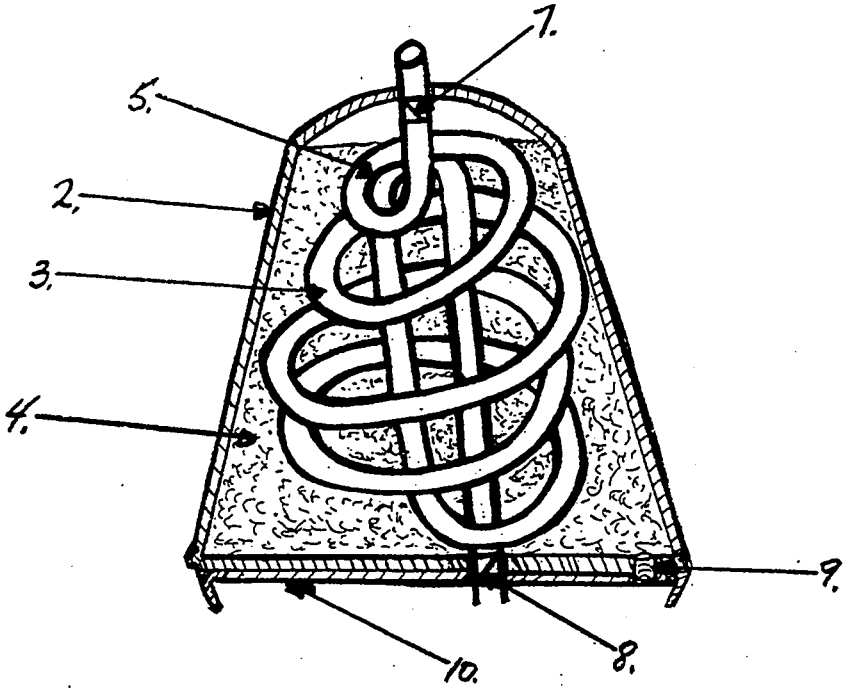
FIG. 2 is a side yew cutaway of the embodiment of this invention.
Figure 3:
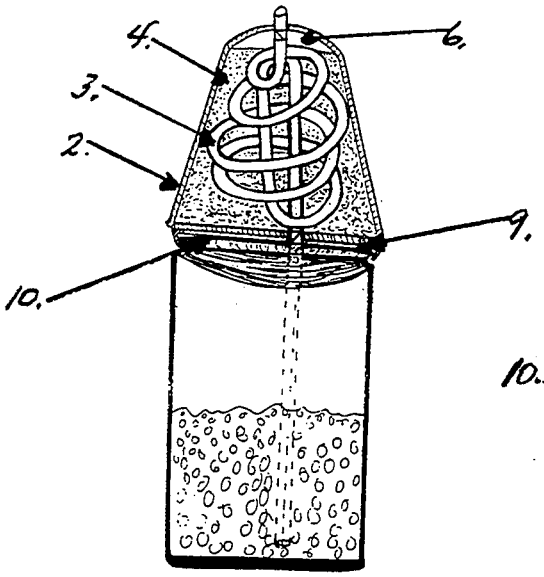
FIG. 3 is a side view cutaway of the embodiment mounted on a popular type of soft drink container.
Figure 4:
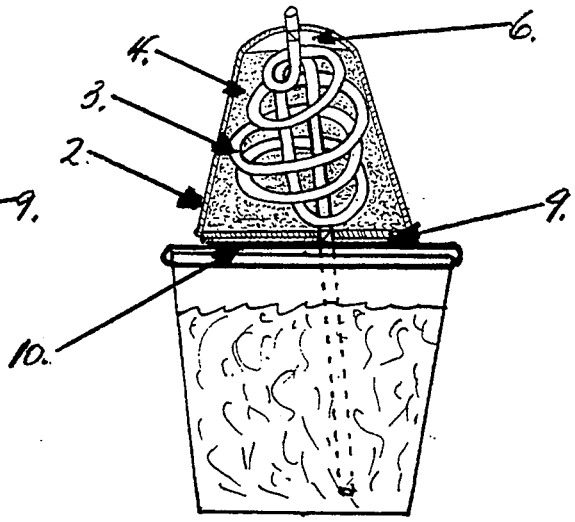
FIG. 4 is a side view cutaway of the embodiment mounted on a popular type of beverage container.
Figure 5:
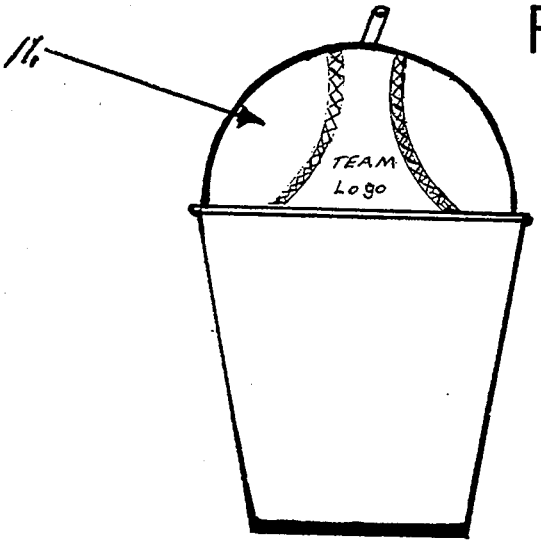
FIG. 5 is a front view of the Thermal Exchanger covered by an advertising outer jacket, in this case one haft of a baseball. mounted on a cup type beverage container.
Figure 6:
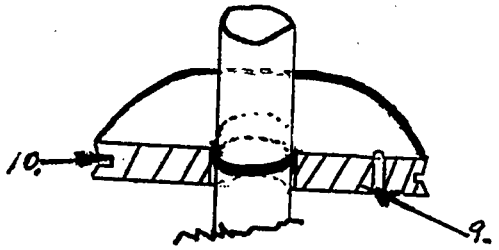
FIG. 6 is a side view of an attaching device which, when attached to the bottom of the embodiment and when placed over the top of a beverage can, acts as a non-spilling can straw.
Figure 7:
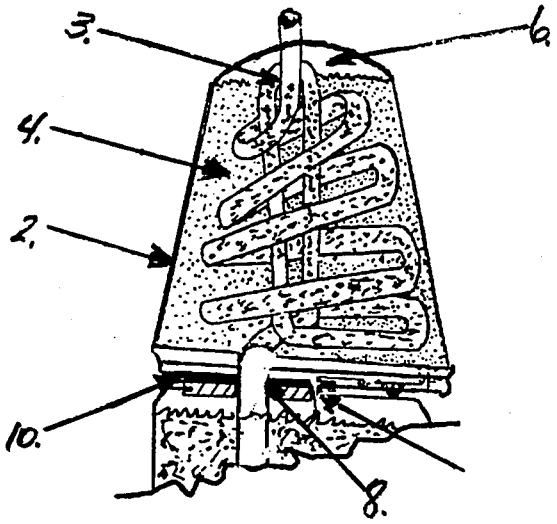
FIG. 7 is a side view cutaway of the embodiment of the invention with the non-spilling can top attaching device securing the embodiment to a beverage can.

The numerals on the drawings represent the following parts of the embodiments.

The outer jacket 1 which acts as the advertising/promotion message surface, acts as the insulated shell for the Thermal Exchanger by helping maintain the cold within the embodiment for a long time. The outer jacket 1 can be rigid or flexible, is not restricted as to size or shape, nor does it have any restriction as to the type of material used in it's composition.

The insulation 2 is put within the Thermal Exchanger housing around the heat retention mass in order to allow the exchanger to retain it's cold state for the longest possible time.

The housing 3 acts as an envelope for the embodiment of the thermal exchanger.

The cold retention mass 4 is the part of the Thermal Exchanger which, when frozen or chilled to a very low temperature, cools the beverage as it is sipped through the straw like device. This cold retention mass 4 can be made from a variety of freezable materials with a gel like substance as the preferred one.

The core 5 is the straw like piece which rum from near the bottom of the beverage container, up through the Thermal Exchanger where it is coiled and looped, and out of the top of the exchanger where it performs the function of the top end of the sipping straw. The outside surface of the core 5 where it is coiled inside the exchanger can be fluted for more efficiency in the heat transfer process but the inside surface of the embodiment will be tubular and smooth for cleaning purposes.

The elevated loop 6 acts as a trap so that the fluids remain in the coil of the core. This trapping effect of the beverage by the elevated loop 6 while the beverage is in the coil of the exchanger gives the cold retention mass 4 time to cool the drink.

The check valve or flapper 7 at the top of the coil where it goes out of the exchanger and becomes the start of the sipping straw, is one alternative means of holding the beverage in the coil.

Another alternative for retaining the beverage in the coil of the exchanger is a check valve or flapper 8 positioned at the inlet end of the coil.

There is an air vent 9 which runs through the cover of the beverage container to allow air into the container to replace the liquid drank by the user in order to prevent the collapse of the beverage container due to atmospheric pressure.

There is a fastening means 10 at the bottom of the Thermal exchanger to permit the exchanger to be attached to beverage cans and cups.

There will be an outer jacket 11 serving as an exterior coveting for the Thermal Exchanger which will be used for advertising on beverage containers. The example shown of this outer jacket 11 is one half of a baseball.

DESCRIPTION OF THE INVENTION

The main embodiment of the invention shown in the drawing has as its principal parts the following: a) a plastic container cap of various sizes to fit containers from a beverage can to a plastic drinking cup; b) a drinking straw like tube which extends from several inches below the plastic container cap up into the container cap and then out the top for several inches above the container cap; c) a freezable retention mass such as a gel of the type that is used in applications as freezer packs; d) a tough outer thermal exchange housing, acting like an envelope, which encases the freezable gel; e) an insulating material which helps the cold retention mass to retain its cold longer; insulation to increase the thermal retention power of the exchanger; and f) an outer jacket surrounding the embodiment.

The drinking straw like tube is tightly coiled into multiple loop coils near the center of it's length, with the all of the coils completely enclosed in the tough outer envelope and with all outer surfaces of the enclosed coils completely immersed in the gel on all sides.

EXPLANATION OF HOW THE INVENTION WORKS

The entire Thermal Exchanger Cap is placed in a freezer for several hours until the freezable gel is either frozen or almost frozen. After it is removed from the freezer, it can be used immediately to cool a beverage, or used a couple of hours later to cool a drink. It is most effective in it's chilling function and will cool the greatest volume of beverage when it is used as soon as possible after it is removed from the freezer before it has to much time to give up it's cold to the surrounding air.

When the user snaps the cap onto the top of a beverage can,, beverage bottle or beverage cup, and starts to sip the beverage through the straw like tube, the beverage is chilled as it passes through the multiple coils of the straw like tube encased in the frozen gel. The heat is transferred from the beverage through the casing of the straw like tube to the gel as the beverage is sipped by the user. The coolness of the beverage reaching the user's mouth will depend on how hard and how fast the user is sipping. With normal strength sips, the beverage will reach the user's mouth at a much cooler temperature the temperature of the beverage in the original container.

CONCLUSION

My Thermal Exchanger for Beverages is a very simple cover type device which is snapped onto the top of a can, bottle or cup which chills the beverage in that can, bottle or cup as the user sips through the straw like device extending out the top of the cover. The device chills any kind of liquid and will chill it from any temperature, even if the liquid in the container is hot. The user can control the amount of chilling of the beverage by how hard and how fast he sips on top end of the straw like tube.

The use of my Thermal Exchanger drink cover means that a user can have a cool drink at any time and in any place, without having to carry or find ice for his drink.

I claim:

1. A method of cooling a beverage in a container having a top opening comprising:

a. providing a hollow thermal exchange beverage container cover, the cover having a cavity with a freezable gel therein and a coiled straw-like tube contacted by the gel, the cover fitting over the top of the beverage container;

b. cooling the cover in a freezer until the freezable gel is either frozen or almost frozen;

c. removing the cover from the freezer and putting the cover over the top opening of the beverage container; and d. sipping the beverage in the container through the coils of the straw-like tube, the beverage being cooled by the gel contacting the tube before reaching the user's mouth.

* * * * *